US005849469A

United States Patent [19]

Crawley

[11] Patent Number: 5,849,469

[45] Date of Patent: Dec. 15, 1998

[54] PROCESS FOR FORMING AN IMAGE USING NOVEL MAGNETA COUPLERS FOR COLOR PHOTOGRAPHY

[75] Inventor: Michael William Crawley, Kingswood, United Kingdom

[73] Assignee: Eastman Kodak Company, Rochester, N.Y.

[21] Appl. No.: 944,108

[22] Filed: Oct. 6, 1997

Related U.S. Application Data

[63] Continuation of Ser. No. 570,372, Dec. 11, 1995, abandoned, which is a continuation of Ser. No. 87,819, Jul. 8, 1993, abandoned.

[30] Foreign Application Priority Data

Jan. 8, 1991 [GB] United Kingdom ..... 9100321.0

[51] Int. Cl.[6] ..... G03C 5/18; G03C 5/26

[52] U.S. Cl. ..... 430/470; 430/464; 430/467; 430/476; 430/434; 430/435; 430/558; 430/387

[58] Field of Search ..... 430/543, 558, 430/464, 467, 470, 476, 434, 435, 387

[56] References Cited

U.S. PATENT DOCUMENTS 4,910,127 3/1990 Sakaki et al. ..... 430/558

FOREIGN PATENT DOCUMENTS 252288 1/1988 European Pat. Off. .

6556777 8/1993 European Pat. Off. ..... 430/558

OTHER PUBLICATIONS

Research Disclosure 16216, pp, 73–75, 1977 (Bogie and Norris).

James The Theory of the Photographic Process, 3rd Ed. 1966, p. 387.

*Primary Examiner*—Geraldine Letscher

*Attorney, Agent, or Firm*—Arthur E. Kluegel

[57] ABSTRACT

The invention provides a novel magenta coupler of the formula (I)

wherein $R^1$ and $R^2$ are the same or different and are selected from H, alkyl, substituted alkyl, aryl, substituted aryl, heteroaryl, alkylthio, carboxylic acid or ester, primary or secondary amido, sulphonamido, mono or disubstituted amino, alkoxy or aryloxy; and X is H or a group capable of being released on oxidative coupling with a colour coupler.

These magenta couplers do not have secondary dye absorptions in the blue region of the spectrum which leads to a better colour reproduction and are readily and economically synthesized.

4 Claims, No Drawings

PROCESS FOR FORMING AN IMAGE USING NOVEL MAGNETA COUPLERS FOR COLOR PHOTOGRAPHY

This is a Continuation of application Ser. No. 08/570,372, filed Dec. 11, 1995 now abandoned, which is a Continuation of application Ser. No. 08/087,819 filed Jul. 8, 1993, now abandoned.

DESCRIPTION

The present invention relates to novel magenta couplers for colour photography selected from imidazo[1,2-b][1,2,4]triazoles. The triazoles in accordance with the present invention are magenta colour couplers used in silver halide imaging systems where dyes are formed by oxidative coupling within a photographic layer.

Research disclosure 162 pages 73 to 75 1977 (Bogie and Norris) describes the use of imidazo[1,2-b][1,2,4]triazole couplers as colour formers with p-aminophenol developers and p-phenylene diamine developers. The two quoted examples give blue or cyan dyes. Synthetic details of the couplers and hues of the resultant dyes in ethyl acetate are then given. The same two compounds appear in European Patent No. EP-A-252,288 (1988 page 25 compounds 190 and 191) by Konishiroku Photo Industry Company Limited, although no supporting evidence of any kind is given in this document that these compounds have ever been synthesised. The compounds of this invention give practical couplers that provide magenta dyes.

According to the present invention there is provided a colour photographic coupler of the formula

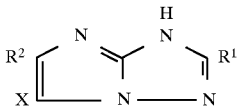

(I)

wherein $R^1$ and $R^2$ are the same or different and are selected from H, alkyl, substituted alkyl, aryl, substituted aryl, heteroaryl, alkylthio, carboxylic acid or ester, primary or secondary amido, sulphonamido, mono- or di-substituted amino, alkoxy or aryloxy; and X is selected from H or a group capable of being released on oxidative coupling with a colour developer. In a preferred form of the invention the colour developer is a p-phenylene diamine and preferably any of $R^1$, $R^2$ or X will contain a group capable of rendering the coupler immobile in a photographic layer.

Further it is preferred that when $R^1$ is aryl, $R^2$ is not aryl or aryl substituted by an $—NO_2$ group.

Preferably $R^2$ is alkyl, and $R^1$ is selected from aryl, substituted aryl, or alkylthio.

X is preferably a group capable of being released on oxidative coupling, and is selected from hydrogen, a halogen or an alkyl or aryl thiol.

The couplers of the above type represented by formula (I) provide magenta dyes of improved hue characteristics compared with those obtained from other magenta couplers in current use.

It is particularly significant in this regard that the dye absorptions of the present invention do not have significant secondary absorptions in the blue region of the spectrum. This leads to better colour reproduction.

In the second place the couplers of the present invention are readily synthesised in high yield and in a short number of steps from inexpensive intermediates which gives advantages in terms of cost of production.

Specific compounds in accordance with the above identified application are listed herein under.

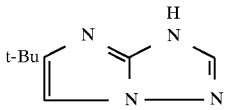

(1)

6-t-Butyl-1-H-imidazo[1,2-b]-[1,2,4]triazole

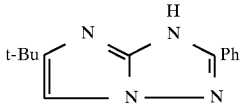

(2)

2-phenyl-6-t-butyl-1-H-imidazo[1,2-b]-[1,2,4]triazole

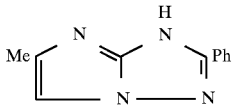

(3)

2-phenyl-6-methyl-1-H-imidazo[1,2-b]-[1,2,4]triazole

-continued
(4)
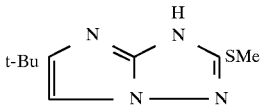
2-Methylthio-6-t-butyl-1-H-imidazo[1,2-b][1,2,4]triazole
(5)
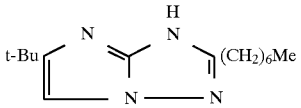
2-Heptyl-6-t-butyl-1-H-imidazo[1,2-b]-[1,2,4]triazole
(6)
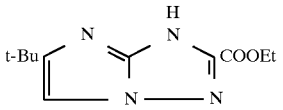
Ethyl 6-t-butyl-1-H-imidazo[1,2-b][1,2,4]-triazolyl-2-carboxylate
(7)
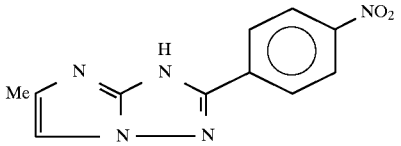
2-(4-Nitrophenyl)-6-methyl-1-H-imidazo-[1,2-b][1,2,4]triazole
(8)
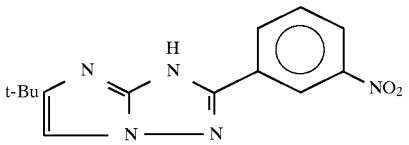
2-(3-Nitrophenyl)-6-t-butyl-1-H-imidazo-[1,2-b][1,2,4]triazole
(9)
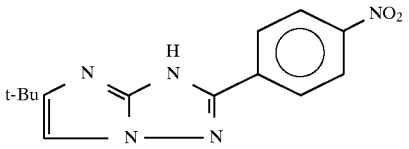
2-(4-Nitrophenyl)-6-t-butyl-1-H-imidazo-[1,2-b][1,2,4]triazole
(10)
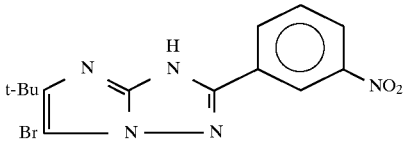
2-(3-Nitrophenyl)-5-bromo-6-t-butyl-1-H-imidazo[1,2-b][1,2,4]triazole
(11)
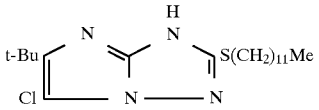
2-(Dodecylthio)-5-chloro-6-t-butyl-1-H-imidazo[1,2-b][1,2,4]triazole -continued (12)

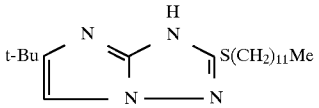

2-(Dodecylthio)-6-t-butyl-1-H-imidazo-[1,2-b][1,2,4]triazole (13)

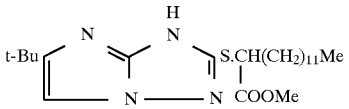

Methyl 2-(6-t-butyl-1-H-imidazo[1,2-b][1,2,4]triazol-2-ylthio)tetradecanoate (14)

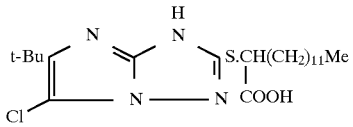

2-(6-t-Butyl-5-chloro-1-H-imidazo [1,2-b][1,2,4]-triazol-2-ylthio)-tetradecanoic acid (15)

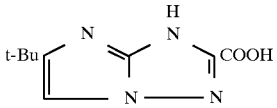

6-t-Butyl-1-H-imidazo[1,2-b][1,2,4] triazole-2-carboxylic acid (16)

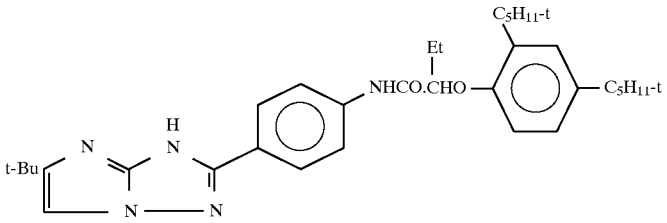

N-[4-(1-H-6-t-butylimidazo[1,2-b][1,2,4]triazol-2-yl)-phenyl]-2-(2,4-di-t-pentylphenoxy)butanamide (17)

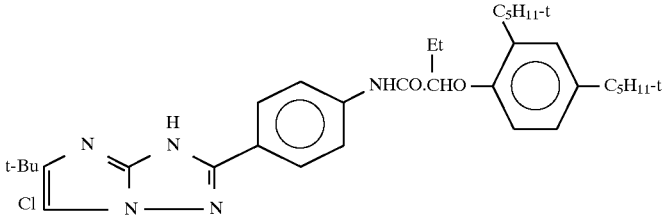

N-[4-(1-H-6-t-butyl-5-chloroimidazo[1,2-b][1,2,4]triazol-2-yl)phenyl]-2-(2,4-di-t-pentylphenoxy)butanamide (18)

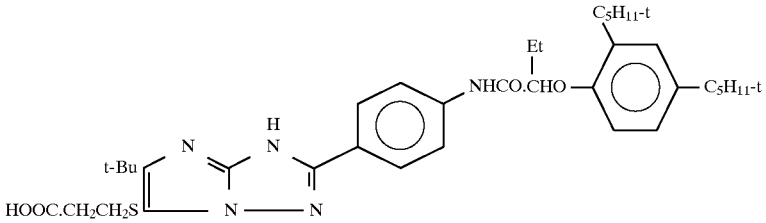

N-(4-[1-H-6-t-butyl-5-(2-carboxyethylthio)imidazo[1,2-b]-[1,2,4]triazol-2-yl]phenyl)-2-(2,4-di-t-pentylphenoxy)-butanamide -continued
(19)
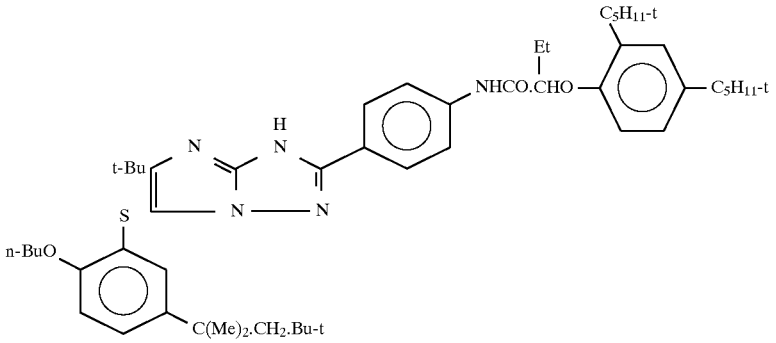
N—(4-[1-H-6-t-butyl-5-(2-n-butyloxy-5-t-octylphenylthio)-imidazo[1,2,-b][1,2,4]-triazol-2-yl]phenyl)-2-(2,4-di-t-pentylphenoxy)butanamide
(20)
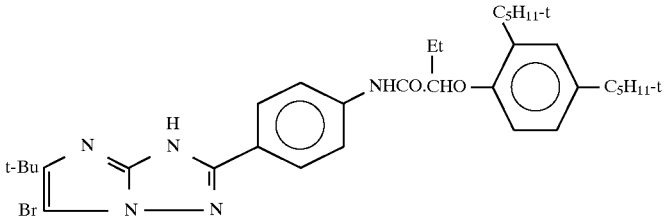
N-[4-(1-H-6-t-butyl-5-bromoimidazo[1,2-b][1,2,4]triazol-2-yl-phenyl]-2-(2,4-di-t-pentylphenoxy)butanamide
(21)
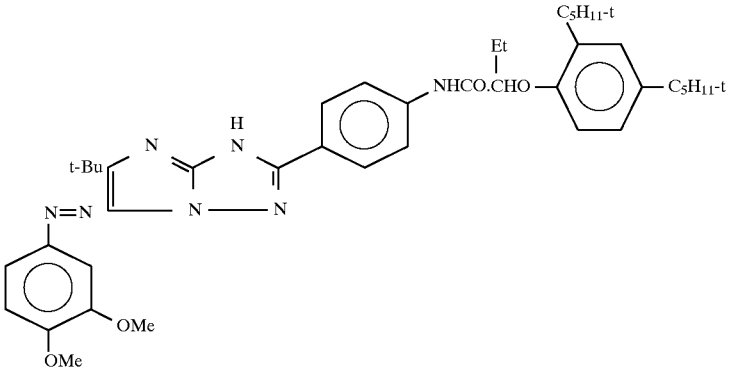
N-(4-[1-H-6-t-butyl-5-(3,4-dimethoxyphenylazo)imidazo-[1,2-b][1,2,4]-triazol-2-yl]phenyl)-2-(2,4-di-t-pentylphenoxy)butanamide
(22)
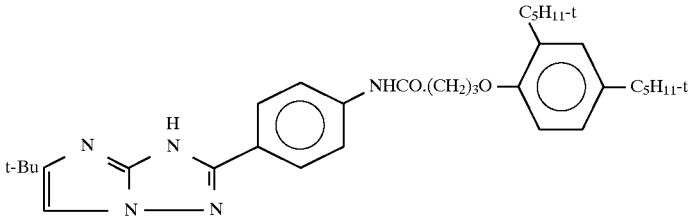
N-[4-(1-H-6-t-butylimidazo[1,2-b][1,2,4]triazol-2-yl) phenyl]-4-(2,4-di-t-pentylphenoxy)butanamide -continued (23)

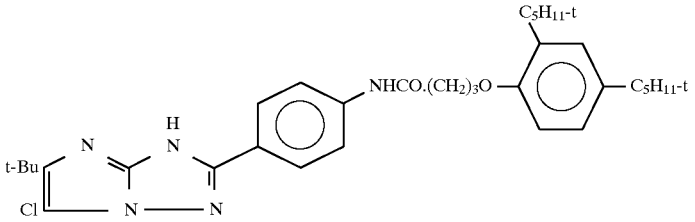

N-[4-(1-H-6-t-butyl-5-chloroimidazo[1,2,b][1,2,4]-triazol-2-yl)phenyl]-4-(2,4-di-t-pentyphenoxy)-butanamide (24)

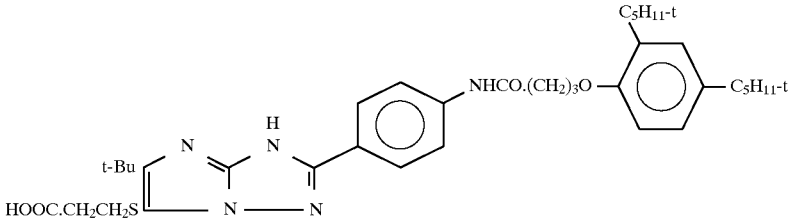

N-(4-[1-H-6-t-butyl-5-(2-carboxyethylthio)imidazo-[1,2-b][1.2.4]triazol-2-yl]phenyl)-4-(2,4-di-t-pentylphenoxy)butanamide (25)

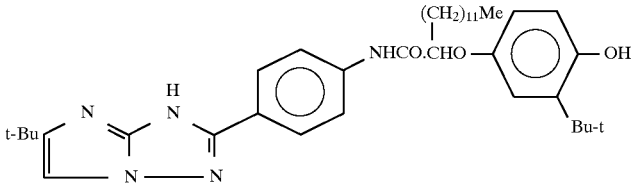

N-[4-(1-H-6-t-butylimidazo[1,2-b][1,2,4]triazol-2-yl)-phenyl]-2-(4-hydroxy-3-t-butylphenoxy)tetradecanamide (26)

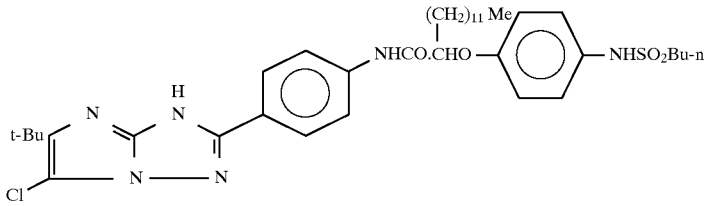

N-[4-(1-H-6-t-butyl-5-chloroimidazo[1,2,-b][1,2,4]-triazol-2-yl)phenyl]-2-(4-n-butylsulphonamidophenoxy)-tetradecanamide (27)

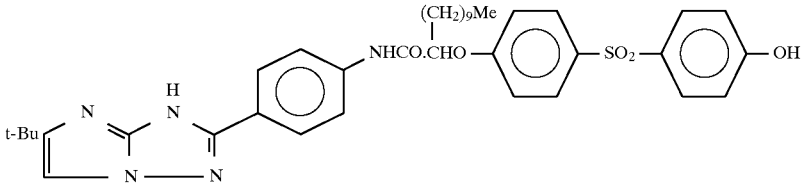

N-[4-(1-H-6-t-butylimidazo[1,2-b][1,2,4]triazol-2-yl)-phenyl]-2-[4-(4-hydroxyphenylsulphonyl)phenoxy]-dodecanamide (28)

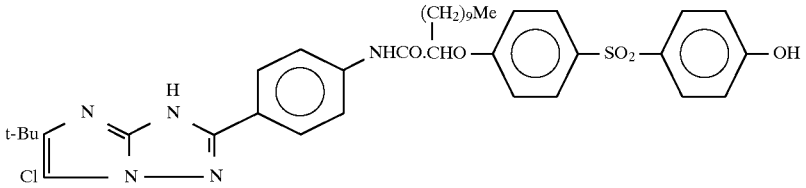

N-[4-(1-H-6-t-butylimidazo-5-chloro-[1,2-b][1,2,4]-triazol-2-yl)phenyl]-2-[4-(4-hydroxyphenylsulphonyl)-phenoxy]dodecanamide -continued (29)

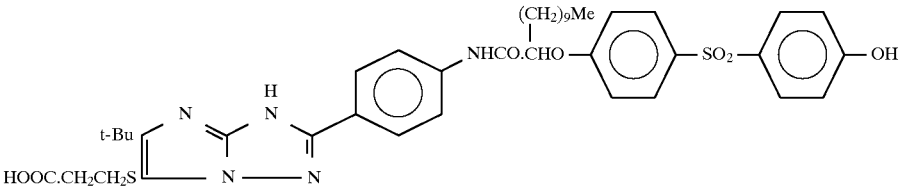

N-(4-[1-H-6-t-butyl-5-(2-carboxyethylthio)imidazo[1,2-b]-[1,2,4]triazol-2-yl]phenyl)-2-[4-(4-hydroxyphenylsulphonyl)-phenoxy]dodecanamide (30)

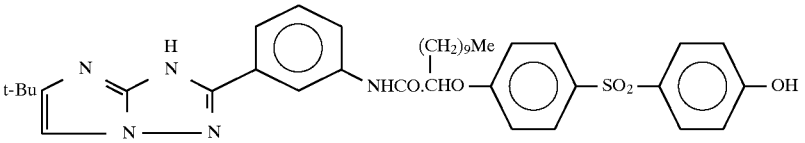

N-[3-(1-H-6- t-butylimidazo[1,2-b][1,2,4]-triazol-2-yl)-phenyl-2-[4-(4-hydroxyphenylsulphonyl)phenoxy]-dodecanamide (31)

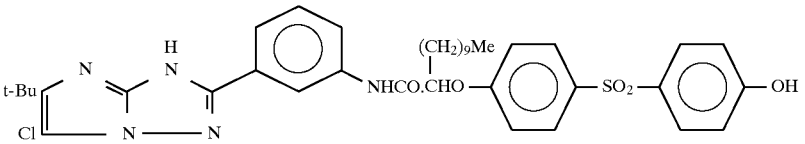

N-[3-(1-H-6-t-butyl-5-chloroimidazo[1,2-b][1,2,4]triazol-2-yl)phenyl]-2-[4-(4-hydroxyphenylsulphonyl)phenoxy]-dodecanamide (32)

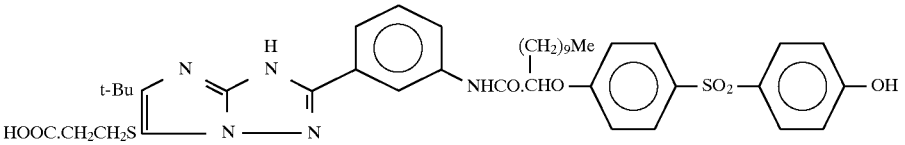

N-[3-(1-H-6-t-butyl-5-carboxyethylthio)imidazo[1,2-b]-[1,2,4]triazol-2-yl]phenyl)-2-]4-(4-hydroxyphenylsulphonyl)-phenoxy]dodecanamide (33)

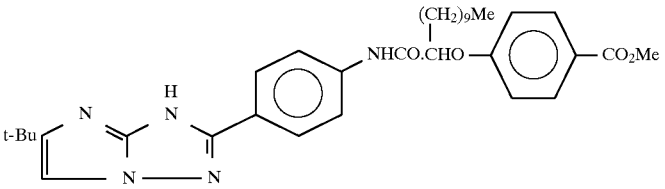

N-[4-(1-H-6-t-butylimidazo[1,2-b][1,2,4]triazol-2-yl)-phenyl]-2-(4-methoxycarbonylphenoxy)dodecanamide (34)

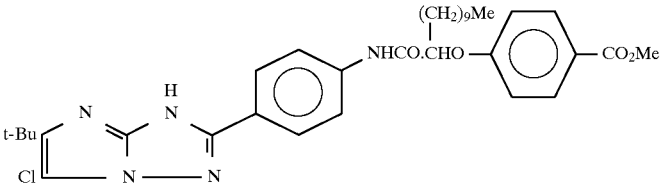

N-[4-(1-H-6-t-butyl-5-chloroimidazo[1,2-b][1,2,4] triazol-2-yl)phenyl]-2-(4-methoxycarbonylphenoxy]-dodecanamide -continued (35)

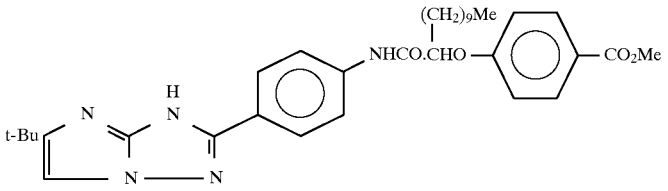

N-[4-(1-H-6-t-butylimidazo[1,2,-b][1,2,4]triazol-2-yl)-phenyl]-2-(4-carboxyphenoxy)dodecanamide (36)

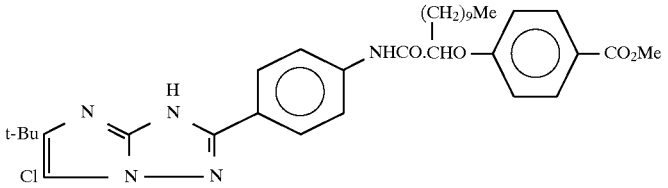

N-[4-(1-H-6-t-butyl-5-chloroimidazo[1,2-b][1,2,4]-triazol-2-yl)phenyl]-2-(4-carboxyphenoxy)dodecanamide (37)

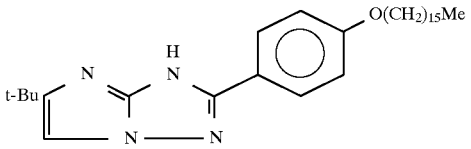

1-H-6-t-butyl-2-(4-hexadecyloxyphenyl)imidazo[1,2-b]-[1,2,4]triazole (38)

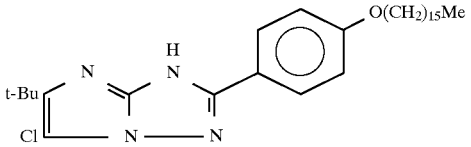

1-H-6-t-butyl-5-chloro-2-(4-hexadecyloxyphenyl) imidazo[1,2-b][1,2,4]triazole (39)

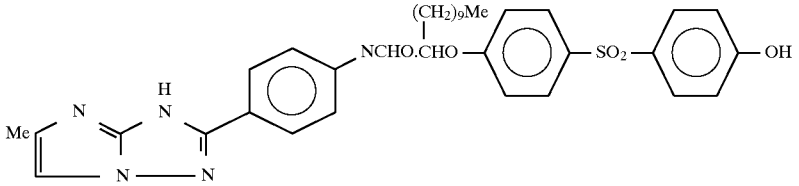

N-[4-(1-H-6-methylimidazo[1,2-b][1,2,4]triazol-2-yl)-phenyl]-2-[4-(4-hydroxyphenylsulphonyl)phenoxy]-dodecanamide (40)

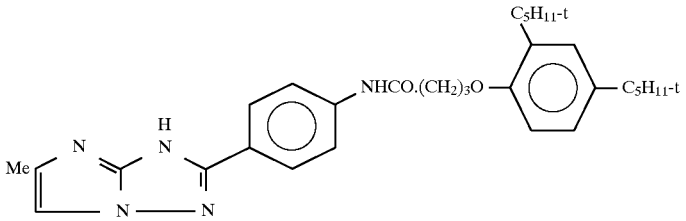

N-[4-(1-H-6-methylimidazo[1,2-b][1,2,4]triazol-2-yl)-phenyl]-4-(2,4-di-t-pentylphenoxy)butanamide -continued

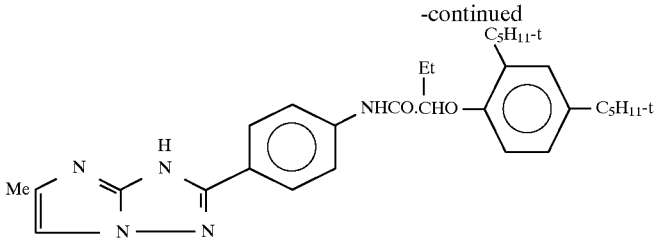

(41)

N-[4-(1-H-6-methylimidazo[1,2-b][1,2,4]triazol-2-yl)phenyl-2-(2,4-di-t-pentylphenoxy)butanamide

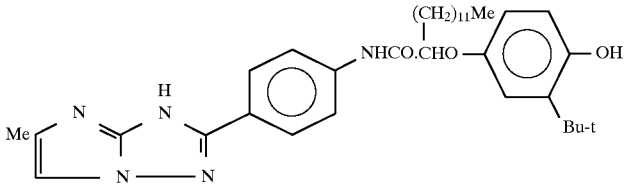

(42)

N-[4-(1-H-6-methylimidazo[1,2-b][1,2,4]triazol-2-yl)-phenyl[-2-(4-hydroxy-3-t-butylphenoxy)tetradecanamide

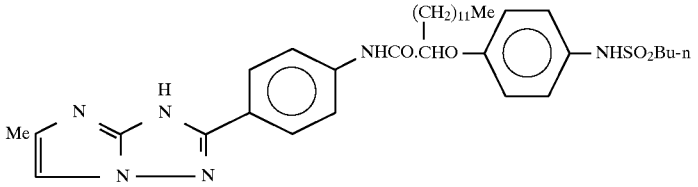

(43)

N-[4-(1-H-6-methylimidazo[1,2-b][1,2,4]triazol-2-yl])-phenyl]-2-(4-n-butylsulphonamidophenoxy)tetradecanamide

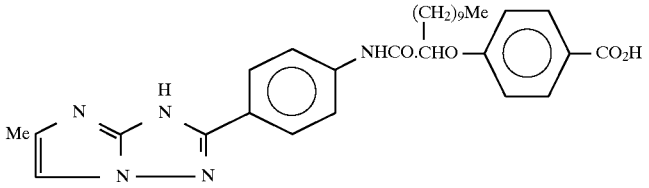

(44)

N-[4-(1-H-6-t-butylimidazo[1,2-b][1,2,4]triazol-2-yl)-phenyl]-2-(4-carboxyphenoxy)dodecanamide A photographic element incorporating the couplers of the invention can be a single colour element or a multicolour element. In a multicolour element, the magenta dye-forming coupler combinations of this invention would usually be associated with a green-sensitive emulsion, although they could be associated with an emulsion sensitised to a different region of the spectrum, or with a panchromatically sensitised, orthochromatically sensitised or unsensitised emulsion. Multicolour elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolour photographic element comprises a support bearing yellow, magenta and cyan dye image-forming units comprising at least one blue-, green- or red-sensitive silver halide emulsion layer having associated therewith at least one yellow, magenta or cyan dye-forming coupler respectively.

The element can contain additional layers, such as filter and barrier layers.

In the following discussion of suitable materials for use in the emulsions and elements of this invention, reference will be made to Research Disclosure, December 1989, Item 308119, published by Industrial Opportunities Ltd., The Old Harbourmaster's, 8 North Street, Emsworth, Hants PO1O 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the coupler combinations of this invention, the elements of the invention can include additional couplers as described in Research Disclosure Section VII, paragraphs D, E, F and G and the publications cited therein. The coupler combinations of this invention and any additional couplers can be incorporated in the elements and emulsions as described in Research Disclosures of Section VII, paragraph C and the publications cited therein.

The photographic elements of this invention or individual layers thereof, can contain brighteners (see Research Disclosure Section V), antifoggants and stabilisers (see Research Disclosure Section VI), antistain agents and image dye stabiliser (see Research Disclosure Section VII, paragraphs I and J), light absorbing and scattering materials (see Research Disclosure Section VIII), hardners (see Research Disclosure Section X), plasticisers and lubricants (see Research Disclosure Section XII), antistatic agents (see Research Disclosure Section XIII), mating agents (see Research Disclosure Section XVI), and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a colour developing agent to reduce developable silver halide and oxidise the colour developing agent. Oxidised colour developing agent in turn reacts with the coupler to yield a dye.

Preferred colour developing agents are p-phenylene diamines. Especially preferred are 4-amino-3-methyl-N,N-diethylaniline hydrochloride, 4-amino-3-methyl-N-ethyl-N-β-(methanesulphonamido)-ethylaniline sulphate hydrate, 4-amino-3-methyl-N-ethyl-N-β-hydroxyethylaniline sulphate, 4-amino-3β-1-(methanesulphonamido)ethyl-N,N-diethylaniline hydrochloride and 4-amino-N-ethyl-N-(2-methoxyethyl)-m-toluidine di-p-toluene sulphonate.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The invention also embraces a method for the manufacture of the compounds in accordance with the present invention. In considering the methods for the preparation of other classes of hetrocyclic coupler the compounds of the present invention can be made relatively simply and in high yield and hence at low economic cost. Of course the cost of manufacture is to an extent dependant on the particular substituents chosen in any particular case, but nevertheless the basic imidazotriazoles of the present invention are simpler and more economic to make.

For example to prepare a pyrazolotriazole coupler such as control coupler C2 in the following text up to 17 synthetic steps are required in going from readily available starting materials to the final compound. This makes the couplers costly to manufacture. The pyrazolone type couplers for example C1 and C2 given below are less expensive to prepare, but the imidazotriazole couplers in accordance with the present invention can be prepared in high yields from inexpensive starting materials in only six or seven nominal steps.

The method of producing the basic imidazotriazole ring system is shown in the following reaction scheme 1.

Scheme 1.

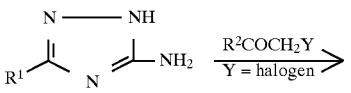

-continued

Scheme 1.

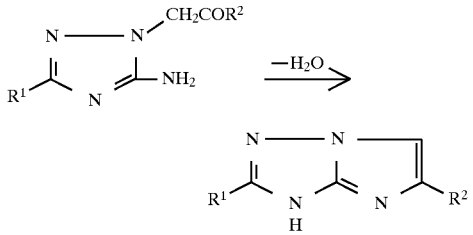

According therefore to a further feature of the present invention there is provided a method for the production of an imidazotriazole of the formula

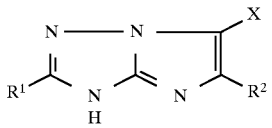

wherein $R^1$, $R^2$ and X are as given above;

which comprises the steps of a) reacting a 3-amino-1,2,4-triazole with a 2-haloketone in the presence of a solvent and a base to give the corresponding 2-ketoalkyl substituted triazole;

b) dehydrating the product of step a) with a dehydrating agent; and c) optionally attaching a coupling-off group to the product of step b).

In a preferred form of the invention the solvent in step a) is acetonitrile and the base is tetramethylguanidine this step is preferred because the best yields and selectivity are obtained with this solvent/base combination with no alkylation occuring on the 4-nitrogen of the triazole ring.

In a further preferred form of the invention the dehydrating agent in step b) is concentrated sulphuric acid, or other strong mineral acid.

In another preferred form of the invention the coupling-off group (X) is halogen, alkylthio or arylthio.

Where the substituent $R^1$is aryl the preferred method of synthesis of the intermediate triazole (scheme 2) comprises reacting an aryl hydrazide with an S-alkyl isothiourea to provide an acylaminoguanidine derivative which is subsequently thermally dehydrated to a 3-amino-5-aryl-1,2,4-triazole.

Scheme 2.

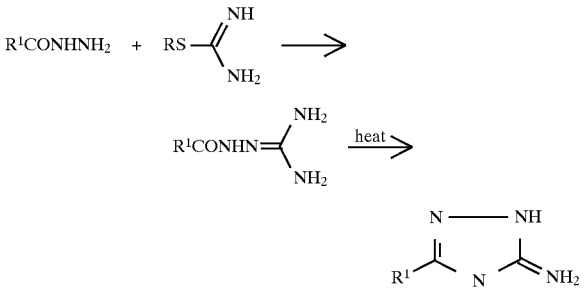

-continued

Scheme 2.

$R^1$ = optionally substituted aryl
R = alkyl

In this preferred form of the invention where the substituent $R^1$ is alkylthio the preferred method of synthesis of the intermediate triazole (scheme 3) comprises selectively reacting 3-amino-5-mercapto-1,2,4-triazole with an alkyl halide in the presence of a base to give a 3-amino-5-alkylthio-1,2,4-triazole.

Scheme 3.

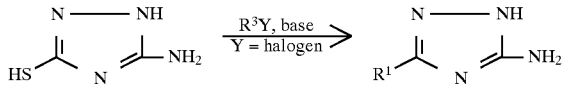

($R^1$ = $R^3S$)

A more specific example of the methodology of synthesis of one of the preferred types of coupler is illustrated in the example below:

ROUTE TO IMIDAZOTRIAZOLES USED IN THE INVENTION

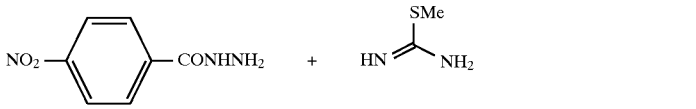

p-nitrophenyl hydrazide S-methyl isothiourea

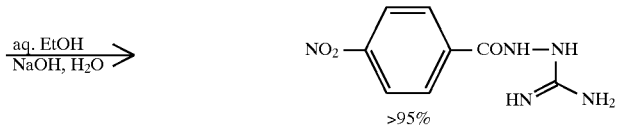

nucleophilic displacement (dissolved with stirring) p-nitrobenzamido guanidine

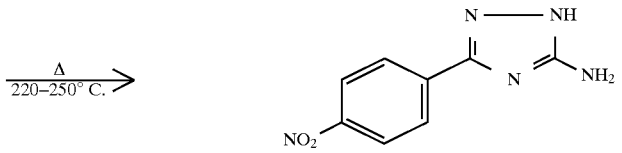

thermal dehydration 5-amino-3-p-nitrophenyl-1,2,4-triazole.

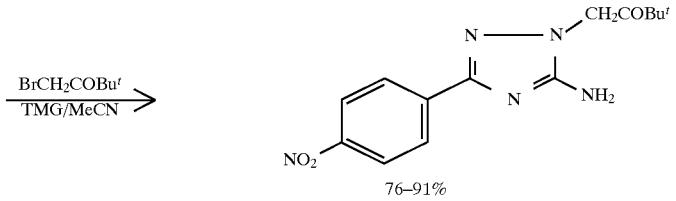

suspended in acetonitrile and tetramethyl guanidine and bromopinacolone 5-amino-1-(1,1-dimethyl acetylmethyl)-3-(4-nitrophenyl)-1,2,4-triazole

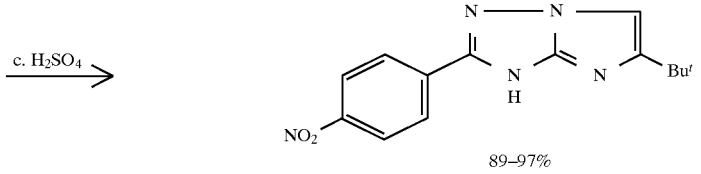

dehydration 1.H-3-t-butyl-2-(4-nitrophenyl) imidazo[1,2-b][1,2,4]triazole.

-continued

ROUTE TO IMIDAZOTRIAZOLES USED IN THE INVENTION

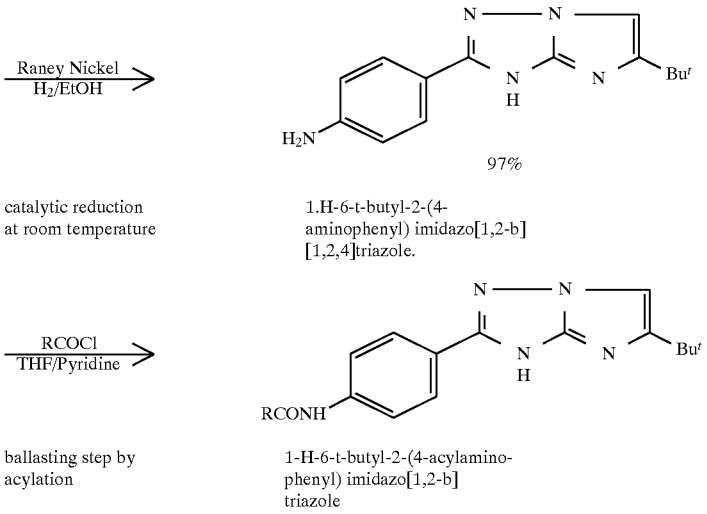

Examples of the present invention will now be given by way of illustration only. All compounds give satisfactory proton nuclear magnetic resonance spectra, mass spectra and infrared spectra unless otherwise specified. The comparison couplers are prepared by standard synthetic methods and are therefore not specifically exemplified.

EXAMPLE 1

Preparation of 2-Phenyl-6-methyl-1-H-imidazo-[1, 2-b][1,2,4]triazole. (Coupler 3)

(a) Benzamidoguanidine.

Aminoguanidine bicarbonate (136.1 g, 1.0 mole) was added to acetic acid (11) and the mixture heated gently on a steam bath until the evolution of carbon dioxide ceased and a clear solution was obtained. The solution was cooled to 15°–20° C., sodium acetate (82.0 g, 1.0 mole) was added, and the mixture stirred until the solid had dissolved. Benzoyl chloride (140.5 g, 1.0 mole) was added dropwise with cooling (<20° C.) and stirring and the mixture then allowed to attain room temperature and stirred overnight (15 hr). The white precipitate (benzoic acid) was filtered off and discarded. The filtrate was concentrated by rotary evaporation to give a clear oil which was dissolved in water (500 ml) and basified with 10N sodium hydroxide solution to pH 14. A lilac coloured solid was obtained which was filtered off and dried in air at room temperature. The yield of product was 116.6 g, 65%.

Calculated for $C_8H_{10}N_4O$; Calc: C 53.9%, H 5.7%, N 31.4%; Found: C 54.5%, H 5.7%, N 31.2%.

(b) 5-Amino-3-phenyl-1,2,4-triazole.

Via Thermal Cyclisation of Benzamidoguanidine.

Benzamnidoguanidine (91.0 g, 0.51mole) was placed in a round bottomed flask and immersed in a Wood's metal bath maintained at 150° C. The temperature was slowly raised to 220° C. The solid melted with dicrepitation at 160°–170° C. with the mass resolidifying at around 200° C. The melt was held at 220° C. for 10 mins and then allowed to cool to room temperature. The solid was crystallised from the minimum amount of water to give the product as a white crystalline solid, 77.7 g, 95%.

Calculated for $C_8H_8N_4$; Calc: C 60.0%, H 5.0%, N 35.0%; Found: C 60.2%, H 5.15%, N 34.9%.

Via Base Promoted Cyclisation of Benzamidoguanidine.

Benzamidoguanidine (1.78 g, 10 mmol) was added to 2M NaOH (50 mls, 100 mmol) and heated on a steam bath for 1 hr. TLC analysis (EtOAc/silica) showed that the reaction was complete. The mixture was cooled to 20° C. and the pH adjusted to 7 with acetic acid. The product precipitated as a white solid which was filtered off and dried in air at room temperature. The yield was 1.26 g, 79%. The TLC and IR were identical to the sample prepared as above.

(c) 5-Amino-1-acetylmethyl-3-phenyl-1,2,4-triazole.

5-Amino-3-phenyl-1,2,4-triazole (1.60 g, 10 mmole) was suspended in dry acetonitrile (25 ml) and chloroacetone (90% tech., 1.13 g, 10 mmol) added. Tetramethylguanidine (1.27 g, 11 mmole) in acetonitrile (5 ml) was added dropwise with stirring. The solid dissolved (slight exotherm) to give a pale brown solution. The mixture was stirred overnight (16 hr) and the solution poured into water (400 ml). The product was extracted into ethyl acetate, dried and concentrated to give a yellow glass 1.91 g, 88%. The material was one spot on TLC (EtOAc/silica), and was used without further purification.

(d) 6-Methyl-2-phenyl-1-H-imidazo[1,2-b][1,2,4]-triazole. (Coupler 3)

5-amino-1-acetylmethyl-3-phenyl-1,2,4-triazole (1.9 g, 8.8 mmol) was stirred with cold concentrated sulphuric acid (25 ml) for 1 hr. TLC analysis (ethyl acetate/silica) showed complete conversion to the product. The brown solution was dripped into sodium bicarbonate solution (1.51) and the buff solid filtered off, washed and dried to afford pure product, 0.98 g, 56%.

Calculated for $C_{11}H_{10}N_4$; Calc: C 66.65%, H 5.1%, N 28.3%; Found: C 66.6%, H 5.4%, N 28.1%.

EXAMPLE 2

Preparation of N-[4-(1-H-6-t-butylimidazo[1,2-b][1,2,4]-triazol-2-yl)phenyl]-2-(2,4-di-t-pentylphenoxy)-butanamide. (Coupler 16)

(a) 4-Nitrobenzamidoguanidine.

S-Methyl-2-thiopseudourea sulphate (32.6 g, 117 mmole) was added to ice-cold 1M sodium hydroxide (235 ml) and a slurry of 4-nitrobenzoic acid hydrazide (21.2 g, 117 mmole) in ethanol (120 ml) added. The mixture was stirred at room temperature for 1.5 days, over which period the colour changed from yellow to bright red. The solid was isolated by filtration, slurried with water (500 ml) and dried under vacuum at 40° C. to give 24.5 g of red product. On standing overnight the filtrate deposited a further 1.5 g of product as fine, dark red needles. The total yield of pure product was 26.0 g, 99%.

(b) 5-Amino-3-(4-nitrophenyl)-1,2,4-triazole.

4-Nitrobenzamidoguanidine (25.8 g, 116 mmole) was heated to 220°–240° C. with occasional stirring for 15–20 mins. During this period the solid changed colour from bright red to bright yellow and water was expelled from the vessel. The yield of pure product was 21.05 g, 88%. Thin layer chromatography (1% acetic acid in ethyl acetate/silica gel) indicated that the product was pure.

(c) 5-Amino-1-(3,3-dimethyl-2-oxobutyl)-3-(4-nitrophenyl)- 1,2,4-triazole.

5-Amino-3-(4-nitrophenyl)-1,2,4-triazole (21.0 g, 102 mmole) was suspended in acetonitrile (200 ml) and bromopinacolone (90% technical grade, 20.6 g, 115 mmol) added followed by the dropwise addition of tetramethylguanidine (13.8 g, 120 mmol) on addition of the base a slight exotherm was noted and the solid partially dissolved. The mixture was stirred overnight (19 hrs) and the solid filtered off, washed with acetonitrile, slurried with water (200 ml) and dried in air to give 27.6 g, 91% of pure product.

Analysis; calculated for $C_{14}H_{17}N_5O_3$; Calc: C 55.4%, H 5.65%, N 23.1%; Found: C 55.2%, H 5.5%, N 23.2%.

(d) 1-H-6-t-butyl-2-(4-nitrophenyl)imidazo[1,2-b]-[1,2,4]-triazole. (Coupler 9)

5-Amino-1-(3,3-dimethyl-2-oxobutyl)-3-(4-nitrophenyl)-1,2,4-triazole (27.5 g, 91.1 mmol) was added in portions to stirred concentrated sulphuric acid (80 ml). The mixture was stirred until all the solid had dissolved and then for 1 hr further. The viscous solution was poured into stirred water (600 ml), stirred for 30 mins and the pale yellow solid filtered off and washed with water. The damp solid was slurried with saturated sodium bicarbonate solution (1.51) filtered, washed with water and dried in a vacuum oven at 70° C. The yield of product, pure to TLC (1:1 ethyl acetate: 60°–80° C. petroleum ether, silica gel), was 25.2 g, 97%.

Analysis; calculated for $C_{14}H_{15}N_5O_2$; Calc: C 58.9%, H 5.3%, N 24.55%; Found: C 58.8%, H 5.35%, N 24.2%.

(e) 1-H-6-t-butyl-2-(4-aminophenyl)imidazor[1,2-b]-[1,2,4] triazole.

1-H-6-t-butyl-2-(4-nitrophenyl)imidazo[1,2-b][1,2,4]-triazole (60 g, 210 mmol) was suspended in ethanol (600 ml) and Raney nickel (ca 6 g) added. The mixture was hydrogenated under a pressure of 30 atmospheres at room temperature, filtered through Kieselghur to give a colourless solution which was evaporated to dryness. The yield of off-white solid was 50.65 g, 95%.

(f) N-[4-(1-H-6-t-butylimidazo[1,2-b][1,2,4]triazol-2-yl)-phenyl]-2-(2,4-di-t-pentylphenoxy)-butanamide. (Coupler 16)

2-(2,4-di-t-pentylphenoxy)butanoic acid (64 g, 200 mmol) was dissolved in ether (300 ml) and thionyl chloride (100 ml) added followed by 2–3 drops of pyridine. The mixture was gently refluxed for 1 hr, and the excess reagent and solvents removed by rotary evaporation. Petroleum ether (60°–80° C. bp) was added and then removed by rotary evaporation to remove residual thionyl chloride. This was repeated twice more to give essentially pure acid chloride.

1-H-6-t-butyl-2-(4-aminophenyl)imidazo[1,2-b][1,2,4]-triazole (50 g, 196 mmol) was dissolved in tetrahydrofuran (300 ml) and pyridine (300 ml). The acid chloride (above) dissolved in tetrahydrofuran (150 ml) was then added dropwise with stirring at 5°–8° C., stirred for 0.5 hr and poured into stirred water (81) containing concentrated hydrochloric acid (500 ml). The resinous solid was extracted into ethyl acetate (21), washed and dried. The solvent was removed and replaced with acetonitrile (1.51) then stirred for 2–3 hr. Crystallisation started after about 10–15 mins. The pale cream solid was filtered off, washed with acetonitrile and dried in air at room temperature. The yield of pure product was 92 g, 84%.

Analysis; calculated for $C_{34}H_{47}N_5O_2$; Calc: C 73.2%, H 8.5%, N 12.6%; Found: C 73.0%, H 8.2%, N 12.4%.

The following couplers were similarly prepared from 1-H-6-t-butyl-2-(4-aminophenyl)imidazo[1,2-b][1,2,4]-triazole (purification method, yield and analysis given):

Coupler (22) Crystallised from ethyl acetate, 75%, Analysis; calculated for $C_{34}H_{47}N_5O_2$; Calc: C 73.2%, H 8.5%, N 12.6%; Found: C 73.1%, H 8.3%, N 12.3%.

Coupler (25) Chromatography/silica gel/1:1 ethyl acetate: 60°–80° C. petrol, 57%, Analysis; calculated for $C_{38}H_{55}N_5O_5$; Calc: C 72.5%, H 8.8%, N 11.1%; Found: C 72.2%, H 8.8%, N 11.1%.

Coupler (26) Chromatography/silica gel/1:1 ethyl acetate: 60°–80° C. petrol, 60%, Analysis; calculated for $C_{38}H_{56}N_6O_4S$; Calc: C 65.9%, H 8.15%, N 12.1% S 4.6%; Found: C 65.7%, H 8.3%, N 11.9%, S 4.5%.

Coupler (27) Chromatography/silica gel/1:1 ethyl acetate: 60°–80° C. petrol, 51% Analysis; calculated for $C_{38}H_{47}N_5O_5S$; Calc: C 66.5%, H 6.9%, N 10.2%, S 4.7%; Found: C 66.4%, H 6.7%, N 9.8%, S 4.3%.

Coupler (33) Chromatography/silica gel/1:1 ethyl acetate: 60°–80C. petrol, 58%, Analysis; calculated for $C_{34}H_{45}N_5O_3$; Calc: C 71.4%, H 7.9%, N 12.25%; Found: C 71.6%, H 8.0%, N 12.1%.

EXAMPLE 3

Preparation of 2-(1-H-6-t-butylimidazo[1,2-b][1,2,4] triazol-2-ylthio)tetradecanoic acid. Coupler (14)

(a) Methyl 2-(5-amino-1,2,4-triazol-3-ylthio)-tetradecanoate.

5-Amino-3-mercapto-1,2,4-triazole (50.0 g, 0.43 mol) was suspended and stirred in dry acetonitrile (435 ml) and methyl tetradecanoate (144.5 g, 0.45 mol) added. This was followed by the dropwise addition of tetramethylguanidine (85.0 g, 0.44 mol) in acetonitrile (25 ml). The temperature of the mixture was maintained around room temperature with the aid of an ice bath. The solid dissolved (slight exotherm) to give a pale brown solution which was stirred for 2 hr and then poured into water (51). The product was extracted into ethyl acetate, dried and concentrated to give a yellowish oil which was dissolved in 60°–80° C. petrol and stirred until crystallisation was complete. The pure, white product was filtered of washed with a little petrol and dried in air, 63.9 g, 42%.

Calculated for $C_{17}H_{32}N_4O_2S$; Calc: C 57.3%, H 9.05%, N 15.7%, S 9.0%; Found: C 57.4%, H 9.0%, N 15.9%, S 8.7%.

(b) Methyl 2-[5-amino-1-(3,3-dimethyl-2-oxobutyl)-1,2,4-triazol-3-ylthio]tetradecanoate.

Methyl 2-(5-amino-1,2,4-triazol-3-ylthio)tetradecanoate (22.2 g, 0.060 mol) was dissolved and stirred in dry acetonitrile (135 ml) and bromopinacolone (12.9 g, 0.072 mol) added. This was followed by the dropwise addition of tetramethylguanidine (8.3 g, 0.072 mol) in acetonitrile (10 ml). The temperature of the mixture was maintained around room temperature with the aid of an ice bath. The solution was stirred overnight (18 h) and then poured into water (1.51). The product was extracted into ethyl acetate, dried and concentrated to give a yellowish oil, 25.8 g, 95%. TLC (1:1 EtOAc: petrol), NMR and MS indicated that the product was sufficiently pure to proceed to the next stage.

(c) Methyl 2-(1-H-6-t-butylimidazo[1,2-b][1,2,4] triazol-2-ylthio)tetradecanoate. Coupler (13)

The crude product from (3c), (25.7 g, 0.057 mol) was stirred at room temperature with concentrated sulphuric acid (60 ml) for 1.5 h and then dripped into saturated sodium carbonate solution (21). The solution was neutralised to pH 7 with more sodium carbonate and then extracted with ethyl acetate. The extract was washed with water, dried and the solvent removed. The crude product was purified by column chromatography (1:2 ethyl acetate: 60°–80° C. petrol/silica gel) to give the product as a cream powder, 15.4 g, 62%.

Calculated for $C_{23}H_{40}N_4O_2S$; Calc: C 63.3%, H 9.2%, N 12.8%, S 7.3%; Found: C 63.1%, H 9.0%, N 12.9%, S 7.1%.

(d) Methyl 2-(1-H-6-t-butylimidaz[1,2-b][1,2,4] triazol-2-ylthio)tetradecanoic acid. Coupler (14)

Methyl 2-(1-H-6-t-butylimidazo[1,2-b][1,2,4]triazol-2-ylthio)-tetradecanoate (3.5 g, 8.03 mmol) was dissolved in ethanol (35 ml) and a solution of sodium hydroxide (1.0 g, 25 mmol) in water (5 ml) was added at room temperature and stirred for 1.5 h. The solution was dripped into water (400 ml) containing acetic acid (5 ml) to give a milky emulsion which was extracted with ethyl acetate. The extract was washed with water, dried and evaporated to a light oil which was dissolved in diethyl ether (50 ml) and stirred until crystallisation was complete (1–2 h). The white product was filtered off, washed with ether and dried in air, 2.07 g. A second crop was obtained from the filtrate on standing, 0.24 g. The total yield of product was 2.31 g, 68%.

Calculated for $C_{22}H_{38}N_4O_2S$; Calc: C 62.5%, H 9.1%, N 13.3%, S 7.6%; Found: C 62.2%, H 9.0%, N 13.0%, S 7.6%.

Comparison Couplers

Comparison Coupler C1

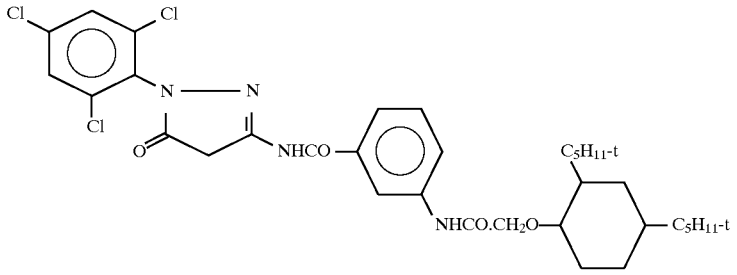

N-((3-([1-(2,4,6-trichlorophenyl)pyrazol-5-one-3-yl]-benzamido))))-2-(2,4-di-t-pentylphenoxy)acetamide Comparison Coupler C2

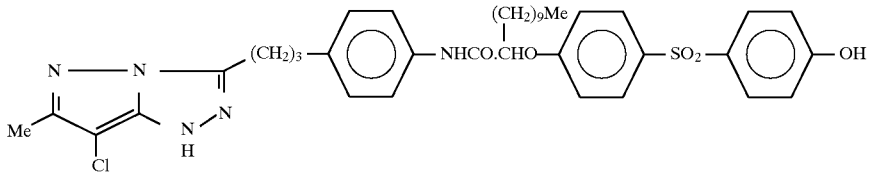

N-((4-[3-(6-methyl-7-chloropyrazolo[2,3-C]triazol-3-yl)propyl]phenyl))-2-[4-(4-hydroxyphenylsulphonyl)phenoxy]dodecanamide Comparison Coupler C3

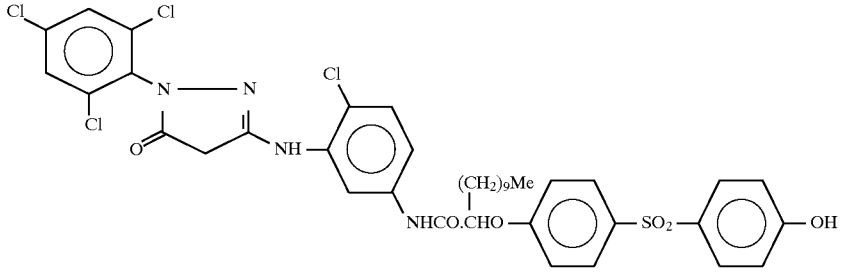

N-(4-chloro-3-[1-(2,4,6-trichlorophenyl)pyrazol-5-one-3ylamine])-2-[4-(4-hydroxyphenylsulphonyl)phenoxyl]-dodecanamide The spectrophotometric data for some of the imidazo triazole couplers in accordance with the present invention is set out below in Table 1. Particularly the hue data for azamethine dyes derived from the particular triazole couplers in ethyl acetate solution are given.

Hue Data for Azamethine Dyes Derived from 1-H-Imidazo-[1,2-b][1,2,4]triazole Couplers in Ethyl Acetate Solution

TABLE 1

| Coupler Number | λ max/nm CD4 (HBW/min) | λ max/nm CD2 (HBW/nm) |
|---|---|---|
| (1) | 523 (82) | 519 (84) |
| (2) | 535 (84) | 530 (86) |
| (3) | 530 (80) | 524 (82) |
| (4) | 536 (85) | 532 (88) |
| (5) | 520 (83) | 516 (85) |
| (6) | 541 (78) | 535 (80) |
| (7) | 543 (82) | 537 (80) |
| (8) | 544 (82) | 537 (86) |

TABLE 1-continued

| Coupler Number | λ max/nm CD4 (HBW/min) | λ max/nm CD2 (HBW/nm) |
|---|---|---|
| (9) | 549 (83) | 541 (85) |
| (12) | 535 (86) | 531 (90) |
| (13) | 542 (82) | 534 (84) |
| (14) | 539 (88) | 536 (92) |
| (15) | * | 540 (90) |
| (16) | 538 (80) | 532 (85) |
| (22) | 538 (83) | 533 (85) |
| (25) | 540 (93) | 533 (88) |
| (26) | 537 (82) | 532 (85) |
| (27) | 538 (84) | 534 (90) |
| (33) | 537 (81) | 532 (85) |
| (41) | 534 (82) | 530 (84) |
| | Comparison Couplers | |
| (C1) | 538 (82) | 526 (74) |
| (C2) | 531 (71) | 524 (71) |
| (C3) | 532 (66) | 526 (67) |

*Dye almost insoluble in EtOAc and fugitive in aqueous base.

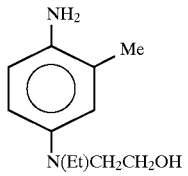

CD4

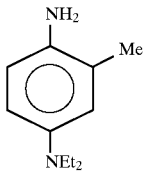

CD2

EXAMPLE 5

Photographic data for these imidazo triazole couplers was studied on coatings processed in a standard KODAK C-41 process. The C-41 process is a standard Kodak commercial process for the development of colour negative films, the E6 process is used for the development of Ektachrome type reversal films.

Coating Format for Evaluation Tests.

| | | |
|---|---|---|
| Gel Supercoat | Kodacolor S/CT | 1.5 gm-2 |
| Sensitised Layer | Ag Emulsion (Standard Factory Kodacolor Emulsion) | 1.61 gm-2 |
| | Coupler Laydown | 1.04 mmolm-2 |
| | Gelatin Laydown | 2.42 gm-2 |
| | Hardener* | 0.06 gm-2 |
| Support | Class 63 Acetate | |

*Bis(vinylsulphonyl)methane

Dispersion formulation:

6% w/w gelatin, 8.8% coupler, coupler:KS1:KSA48 1:0.5:1.5

KS1=tricresyl phosphates

KSA48=2-(2-butoxyethoxy)ethyl acetate

Photographic Results for Imidazotriazole Couplers.

TABLE II

| Coupler | Dmax | Dmin | ν | Speed | λmax | (HBW) |
|---|---|---|---|---|---|---|
| (14)* | 0.44 | 0.14 | 0.35 | 204 | — | — |
| (16) | 0.63 | 0.09 | 0.31 | — | 551 | (104) |
| (17) | 1.77 | 0.11 | 1.15 | 214 | 547 | (101) |
| (18) | 0.37 | 0.09 | 0.29 | 208 | — | — |
| (19) | 0.61 | 0.10 | 0.31 | 235 | 550 | (98) |
| (20) | 1.74 | 0.13 | 1.17 | 214 | 549 | (101) |
| (25) | 1.10 | 0.09 | 0.57 | 225 | 546 | (110) |
| (26) | 1.29 | 0.11 | 0.91 | 185 | 552 | (102) |
| (27) | 2.20 | 0.15 | 1.36 | 230 | 554 | (104) |
| (33) | 0.73 | 0.11 | 0.43 | 203 | 551 | (100) |
| (35) | 1.29 | 0.26 | 1.12 | 243 | 544 | (103) |
| (36) | 1.75 | 0.25 | 1.97 | 205 | 547 | (103) |
| (C1) | 2.38 | 0.15 | 2.29 | 212 | 555 | (96) |

Accordingly the present invention provides a novel magenta coupler for colour photography and a method for the production of the same.

We claim:

1. A process of forming an image comprising contacting a photographic element comprising a coupler having the formula:

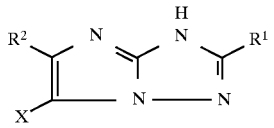

(I)

wherein:

$R^1$ is substituted aryl or alkylthio;

$R^2$ is an unsubstituted alkyl group; and

X is H or a group capable of being released on oxidative coupling with a color developer;

with a p-phenylenediamine color developer.

2. The process of claim 1 wherein $R^2$ contains from 1 to 4 carbon atoms.

3. The process of claim 1 wherein X is selected from the group consisting of hydrogen, halogen, alkylthio, and arylthio.

4. The process of claim 1 wherein $R^1$ or $R^2$ comprises a ballast chain.

* * * * *